US005893537A

United States Patent [19]

Lee

[11] Patent Number: 5,893,537

[45] Date of Patent: Apr. 13, 1999

[54] SAILBOAT-TYPE KITE

[76] Inventor: Zen An Lee, No. 69, Wen-Chang Road, Ling-Ya District, Kaohsiung, Taiwan

[21] Appl. No.: 08/900,540

[22] Filed: Jul. 25, 1997

[51] Int. Cl.[6] ..... A63H 27/08

[52] U.S. Cl. ..... 244/153 R; 244/155 R

[58] Field of Search ..... 244/153 R, 155 R

[56] References Cited

U.S. PATENT DOCUMENTS

| | | | |
|---|---|---|---|
| 606,960 | 7/1898 | Doyle | 244/153 R |
| 3,326,392 | 6/1967 | Rock | 244/155 R |
| 4,450,784 | 5/1984 | Mellinger | 244/153 R |
| 5,417,390 | 5/1995 | Southwick | 244/155 A |
| 5,727,756 | 3/1998 | Rowe | 244/153 R |

*Primary Examiner*—J. Woodrow Eldred
*Attorney, Agent, or Firm*—Bacon & Thomas, PLLC

[57] ABSTRACT

A kite includes a main frame including a longitudinal beam, two peripheral beams, and at least two transverse beams interconnected between the peripheral beams. Each peripheral beam includes a number of positioning rings for respectively receiving two ends of the transverse beams. A number of vertical posts are provided, and each vertical post has a lower end securely attached to an associated transverse beam. Each vertical post includes a number of vertically spaced engaging members thereon. The kite further includes a number of vertically spaced sail devices each including two horizontal rods with a sail mounted therebetween. Each horizontal rod includes an engaging piece securely engaged with one of the engaging members of the associated vertical post.

15 Claims, 6 Drawing Sheets

SAILBOAT-TYPE KITE

BACKGROUND OF THE INVENTION

The present invention relates to a sailboat-type kite.

A kite generally has a flat design and thus lacks variety. The present invention is intended to provide a three-dimensional kite, and more particularly, a sailboat-type kite to improve entertainment effect.

SUMMARY OF THE INVENTION

In accordance with one aspect of the invention, a sailboat-type kite comprises a main frame including a plurality of beams interconnected so as to be adapted to form a contour of a lower portion of a sailboat. The main frame includes a bridle line attached thereto and at least two holes. A plurality of vertical posts are provided and each of which has a lower end securely attached to the associated hole and an upper end. Each vertical post includes a plurality of vertically spaced engaging members thereon. The kite further includes a plurality of vertically spaced sail means each including two horizontal rods with a sail mounted therebetween. Each horizontal rod includes an engaging piece securely engaged with one of the engaging members of the associated vertical post. In addition, a propeller blade means may be rotatably mounted on one of the beams.

In a preferred embodiment of the invention, the main frame includes a longitudinal beam, two peripheral beams, and at least two transverse beams interconnected between the peripheral beams. Each peripheral beam includes a plurality of positioning rings for respectively receiving two ends of the transverse beams. The main frame may be covered by an air-impermeable material.

Each vertical post further includes a string having an upper end securely attached to the upper end thereof, and the string is at an angle with the vertical post and includes a lower end securely attached to the main frame. The string and the associated vertical post includes an auxiliary sail mounted therebetween.

Each sail means further includes at least one tying string means which connect the horizontal rods, and the tying string means includes a first end attached to the main frame and a second end attached to the upper end of the associated vertical post. Preferably, the tying string means connects the horizontal rods on the same vertical post.

In accordance with another aspect of the invention, a kite comprises a main frame including a longitudinal beam, two peripheral beams, and at least two transverse beams interconnected between the peripheral beams. Each peripheral beam includes a plurality of positioning rings for respectively receiving two ends of the transverse beams. Each transverse beam includes a hole defined therein and a bridle line attached thereto. A plurality of vertical posts corresponding to the number of the holes are provided. Each vertical post has a lower end securely attached to the associated hole and an upper end. Each vertical post includes a plurality of vertically spaced engaging members thereon. The kite further includes a plurality of vertically spaced sail means each including two horizontal rods with a sail mounted therebetween. Each horizontal rod includes an engaging piece securely engaged with one of the engaging members of the associated vertical post.

Other objects, advantages, and novel features of the invention will become more apparent from the following detailed description when taken in conjunction with the accompanying drawings.

DESCRIPTION OF THE PREFERRED EMBODIMENTS

Figure 1:
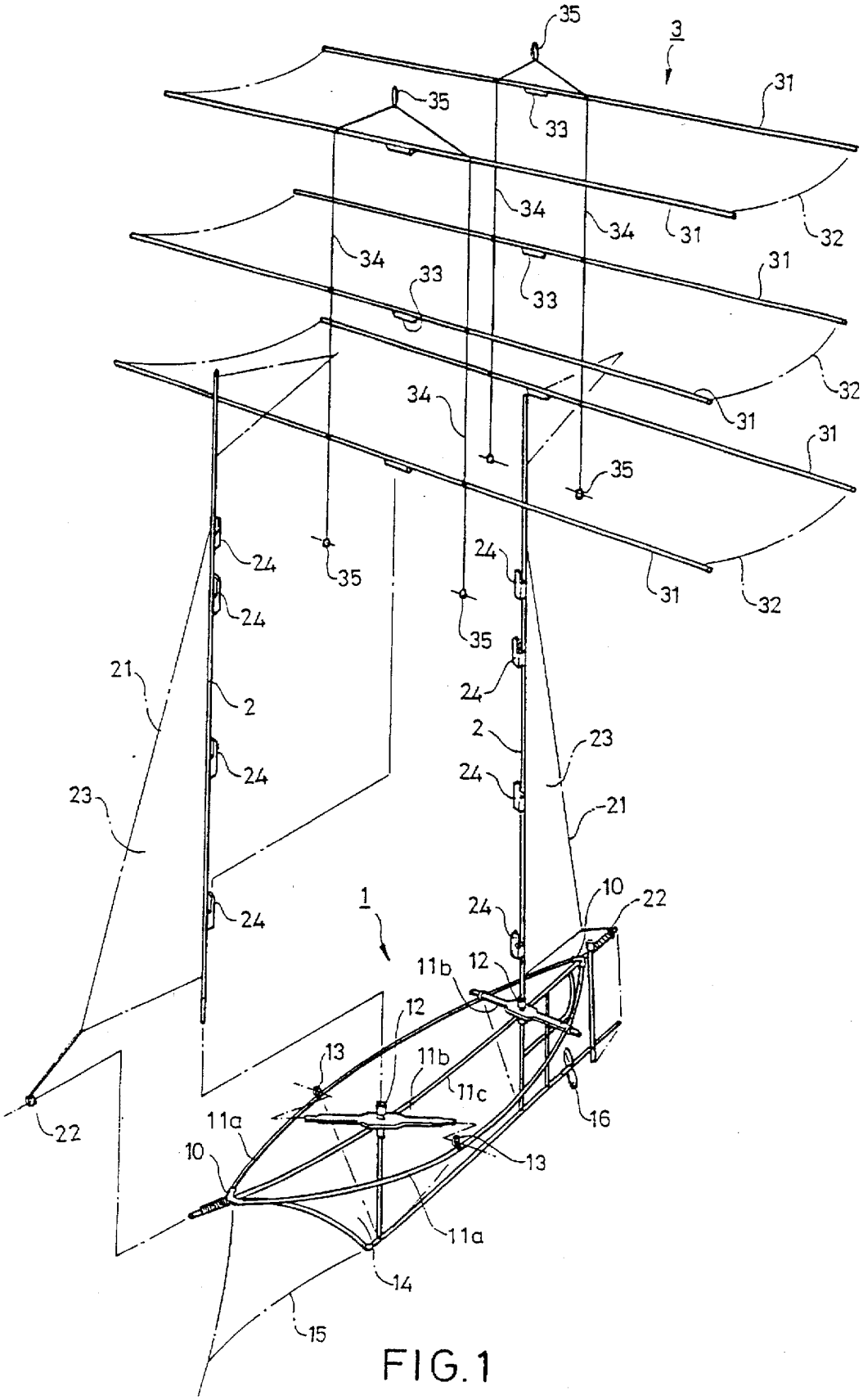
FIG. 1 is an exploded perspective view of a sailboat-type kite in accordance with the present invention.
Figure 2:
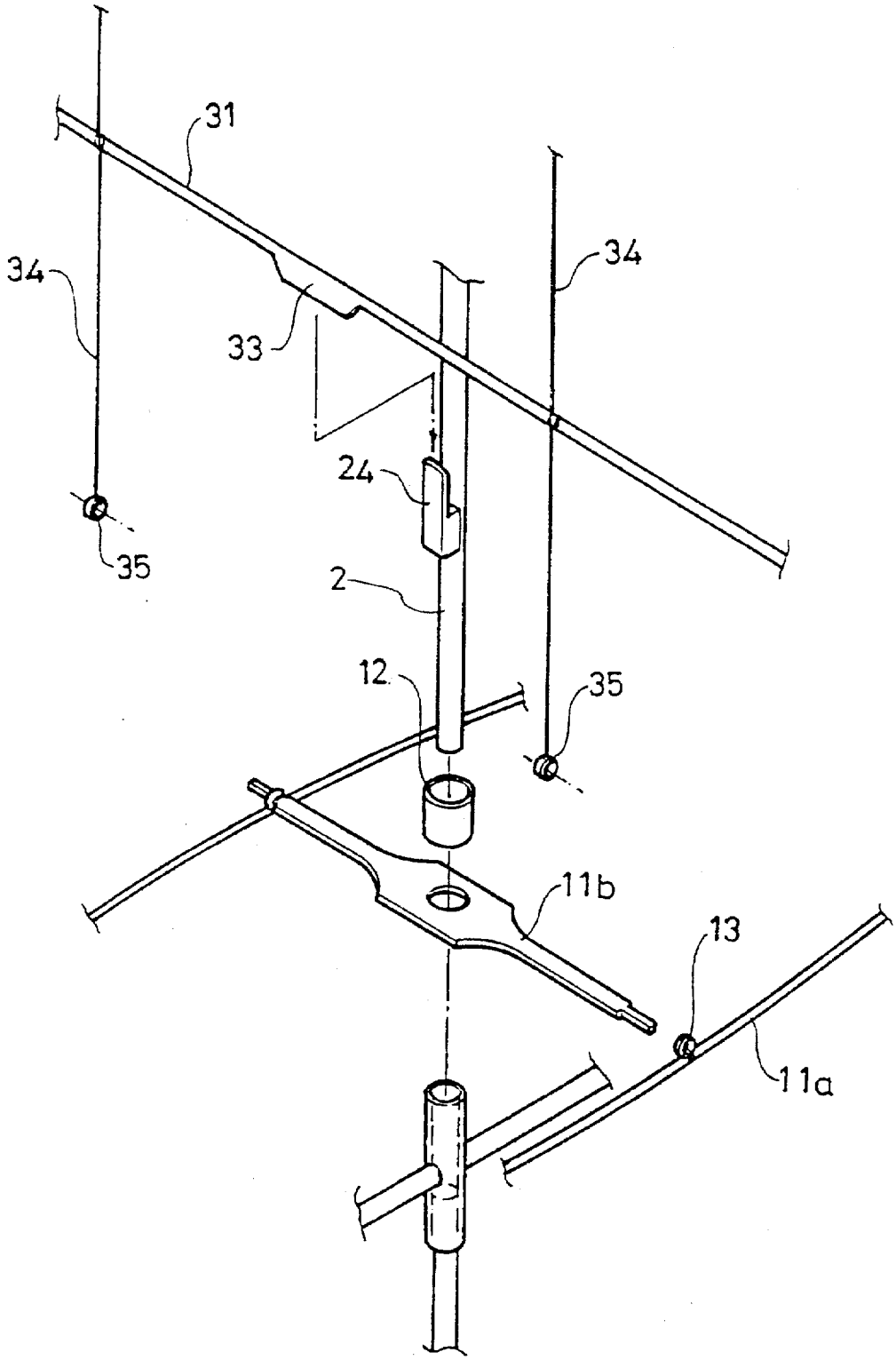
FIG. 2 is an exploded perspective view of a main frame of the sailboat-type kite in accordance with the present invention.
Figure 3:
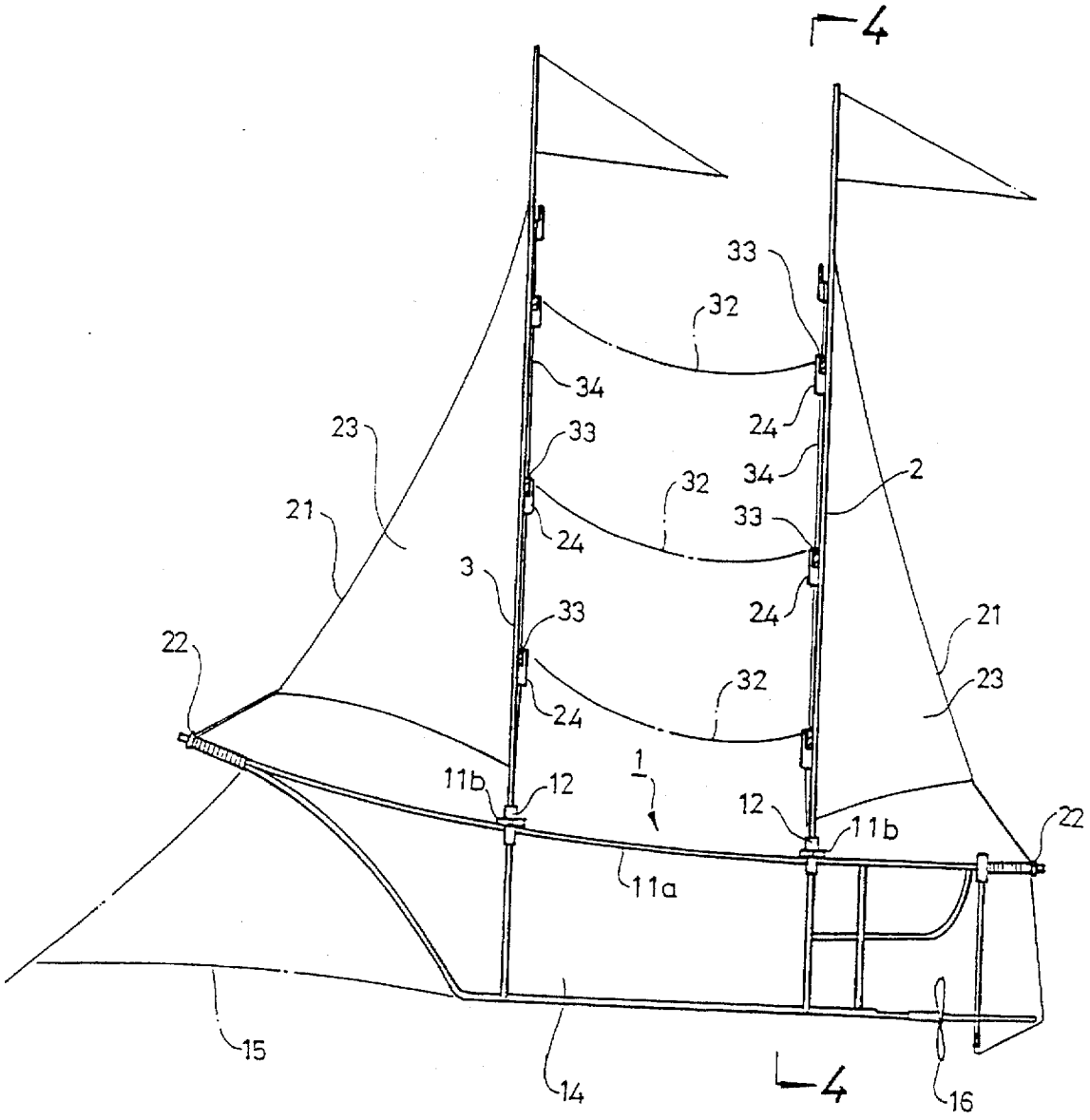
FIG. 3 is a side view of the sailboat-type kite in accordance with the present invention.
Figure 5:
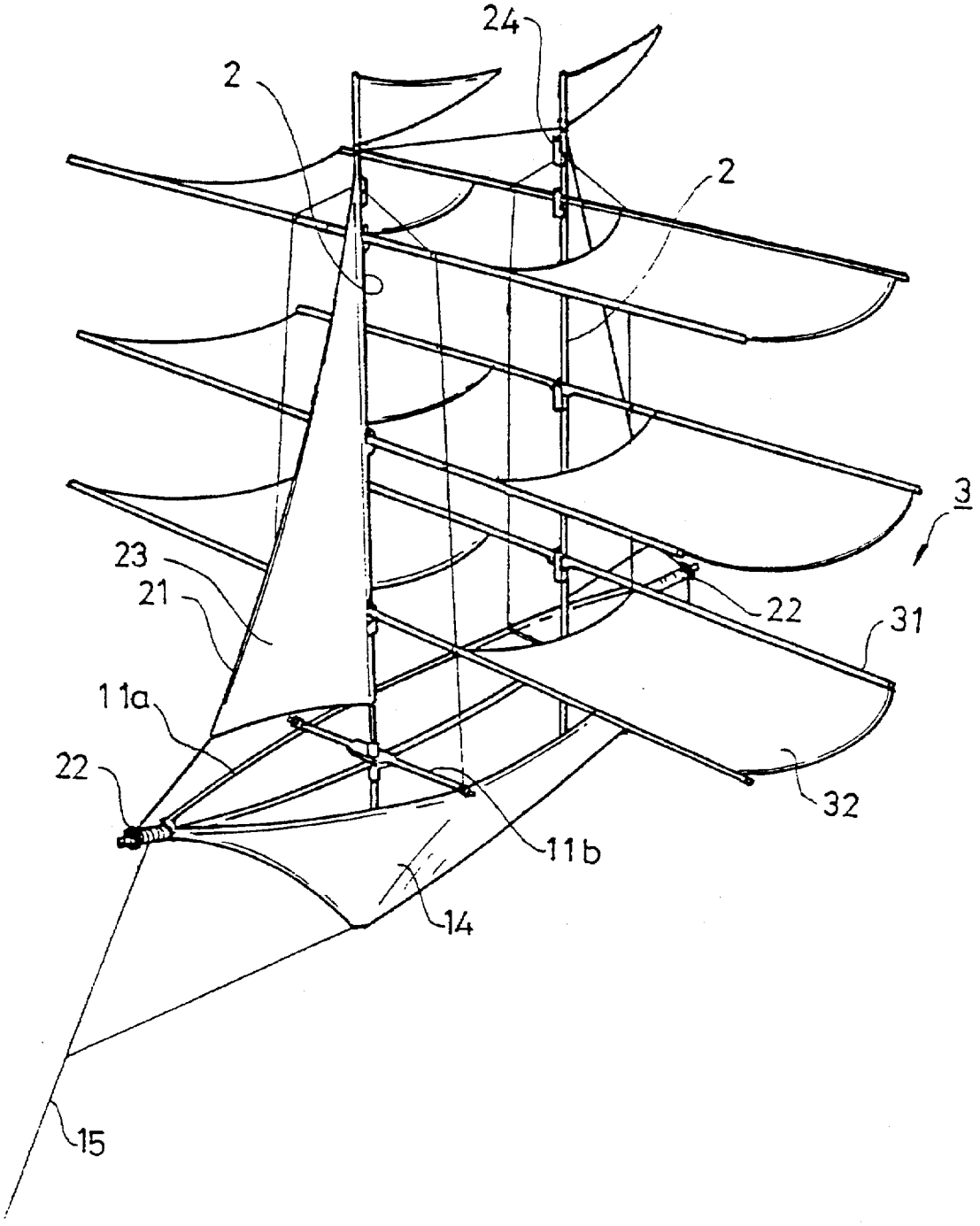
FIG. 5 is a perspective view of the sailboat-type kite in accordance with the present invention.

Referring to the drawings and initially to FIGS. 1 and 5, a sailboat-type kite in accordance with the present invention generally comprises a main frame 1 including a plurality of beams 11*a*, 11*b*, 11*c* which are interconnected to form a structure having a contour similar to a lower portion of a sailboat after being covered by an air-impermeable material, e.g., cloth 14. The main frame can be integral or detachable. As shown in FIGS. 1 to 3, The main frame 1 may further include a propeller blade means 16 mounted on one of the beams 11. The propeller blade means 16 may rotate when wind blows to increase entertainment effect.

In a preferred embodiment of the invention, the main frame 1 may include a longitudinal beam 11*c*, two peripheral beams 11*a*, and at least two transverse beams 11*b* interconnected between the peripheral beams 11*a*. In this embodiment, the main frame 1 includes two transverse beams 11*a* each having two ends respectively, securely received in two positioning rings 13 (preferably made of rubber) which, in turn, are respectively formed the two peripheral beams 11*a*, best shown in FIG. 1. The main frame 1 may include additional beams to form a structure having a contour similar to a lower portion of a sailboat. The main frame 11 has bridle lines 15 attached thereto.

Still referring to FIGS. 1 and 2, each transverse beam 11*b* includes an engaging hole 12 for securely receiving a lower end of a vertical post 2. Each vertical post 2 includes a plurality of vertically spaced engaging members, e.g., hooks 24 formed thereon. Each vertical post 2 may be securely attached to other beams by strings 21. As shown in FIGS. 3 and 5, each string 21 includes an upper end securely attached to an upper end of the associated post 2 and is at an angle with the vertical post 2. A lower end of each string 21 includes a ring 22 so as to be securely mounted to an end of the longitudinal beam 11*a*, and an auxiliary sail 23 may be mounted between the string 21 and the associated vertical post 2.

Figure 4:
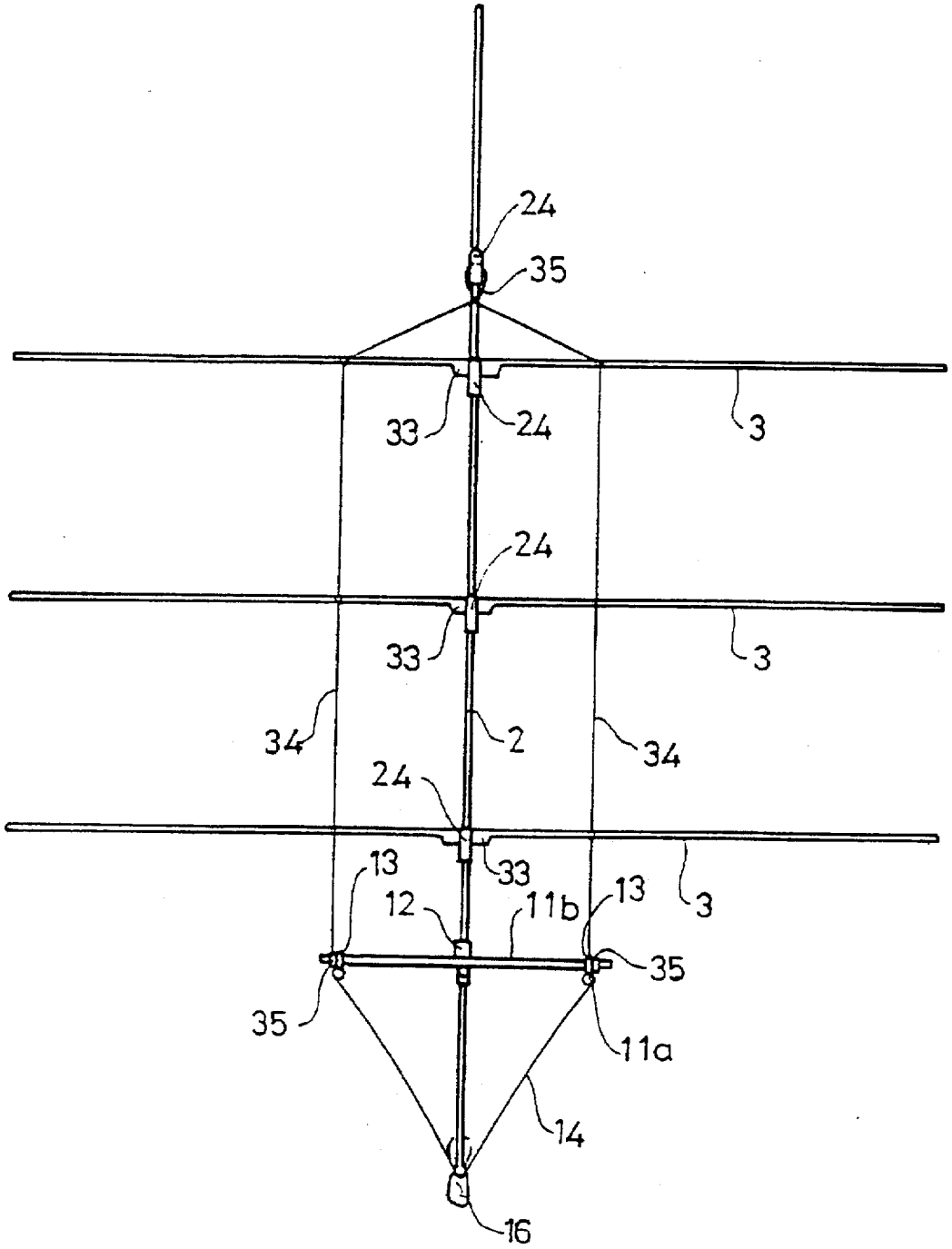
FIG. 4 is a view taken from line 4—4 in FIG. 3.

Referring to FIGS. 1 to 4, the sailboat-type kite of the present invention further includes a plurality of vertically spaced sail means 3 each including two horizontal rods 31 with a sail 32 mounted therebetween. Each horizontal rod 31 includes an engaging piece 33 securely engaged with one of the hooks 24 of the associated vertical post 2. At least one tying string means 34 is provided to connect the horizontal rods 31, best shown in FIG. 1. The tying string means 34 may include an upper loop 35 and two lower loops 35 so as to be respectively tied to the associated vertical post 2 and the main frame 1. As shown in FIGS. 1 and 4, there are two tying string means 34 each for connecting the horizontal rods 31 on the same vertical post 2.

Referring to FIGS. 3 to 5, the sail means 3 of the may allow the kite to be lifted, and the sailboat-type kite configuration provides additional entertainment effect.

Figure 6:
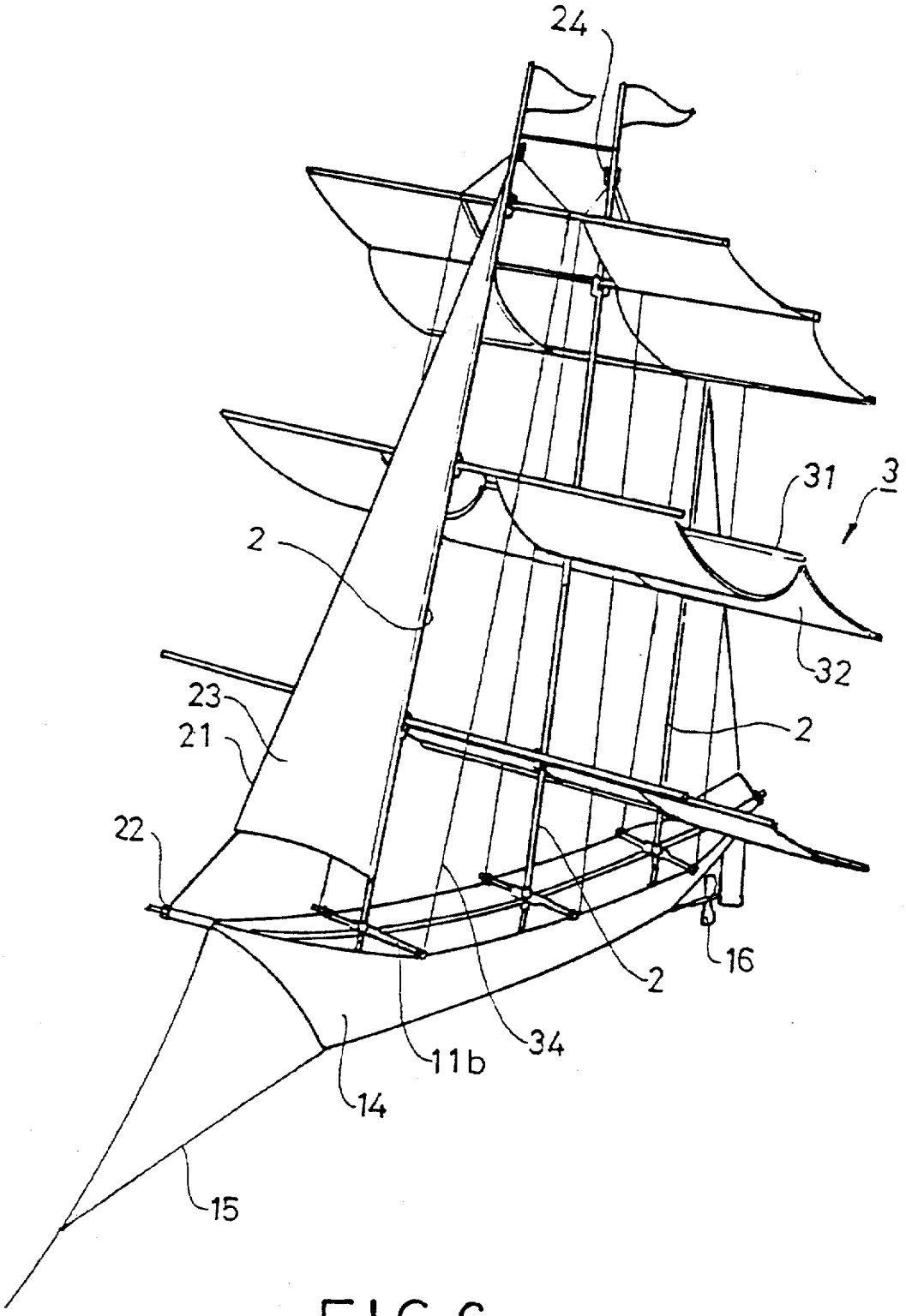
FIG. 6 is a perspective view of a modified embodiment of the sailboat-type kite in accordance with the present invention.

FIG. 6 illustrates a modified embodiment of the present invention, in which three vertical posts 2 are used and additional sail means 3 is provided.

Although the invention has been explained in relation to its preferred embodiment, it is to be understood that many other possible modifications and variations can be made without departing from the spirit and scope of the invention as hereinafter claimed.

What is claimed is:

1. A sailboat-type kite, comprising:

a main frame including a plurality of beams interconnected so as to be adapted to form a contour of a lower portion of a sailboat, the main frame including a bridle line attached thereto, the main frame further including at least two holes, a plurality of vertical posts corresponding to the number of the holes, each said vertical post having a lower end securely attached to the associated hole and an upper end, each said vertical post including a plurality of vertically spaced engaging members thereon, and a plurality of vertically spaced sail means each including two horizontal rods with a sail mounted therebetween, each said horizontal rod including an engaging piece securely engaged with one of the engaging members of the associated vertical post.

2. The sailboat-type kite according to claim 1, wherein the main frame includes a longitudinal beam, two peripheral beams, and at least two transverse beams interconnected between the peripheral beams, each said peripheral beam including a plurality of positioning rings for respectively receiving two ends of said transverse beams.

3. The sailboat-type kite according to claim 1, wherein the main frame is covered by an air-impermeable material.

4. The sailboat-type kite according to claim 1, wherein each said vertical post further includes a string having an upper end securely attached to the upper end thereof, and the string is at an angle with the vertical post and includes a lower end securely attached to the main frame.

5. The sailboat-type kite according to claim 4, wherein the string and the associated vertical post includes an auxiliary sail mounted therebetween.

6. The sailboat-type kite according to claim 1, wherein said sail means further includes at least one tying string means which connect the horizontal rods, and the tying string means includes a first end attached to the main frame and a second end attached to the upper end of the associated vertical post.

7. The sailboat-type kite according to claim 6, wherein the tying string means connects the horizontal rods on the same vertical post.

8. The sailboat-type kite according to claim 1, further comprising a propeller blade means rotatably mounted on one of the beams.

9. A kite, comprising:

a main frame including a longitudinal beam, two peripheral beams, and at least two transverse beams interconnected between the peripheral beams, each said peripheral beam including a plurality of positioning rings for respectively receiving two ends of said transverse beams, each said transverse beam including a hole defined therein, the main frame including a bridle line attached thereto, a plurality of vertical posts corresponding to the number of the holes, each said vertical post having a lower end securely attached to the associated hole and an upper end, each said vertical post including a plurality of vertically spaced engaging members thereon, and a plurality of vertically spaced sail means each including two horizontal rods with a sail mounted therebetween, each said horizontal rod including an engaging piece securely engaged with one of the engaging members of the associated vertical post.

10. The kite according to claim 9, wherein the main frame is covered by an air-impermeable material.

11. The kite according to claim 9, wherein each said vertical post further includes a string having an upper end securely attached to the upper end thereof, and the string is at an angle with the vertical post and includes a lower end securely attached to the main frame.

12. The kite according to claim 11, wherein the string and the associated vertical post includes an auxiliary sail mounted therebetween.

13. The kite according to claim 9, wherein said sail means further includes at least one tying string means which connect the horizontal rods, and the tying string means include a first end attached to the main frame and a second end attached to the upper end of the associated vertical post.

14. The kite according to claim 13, wherein the tying string means connects the horizontal rods on the same vertical post.

15. The kite according to claim 9, wherein the main frame further comprises a propeller blade means rotatably mounted on one of the beams.

* * * * *